US012263926B2

(12) United States Patent
Barnes

(10) Patent No.: US 12,263,926 B2
(45) **Date of Patent: *Apr. 1, 2025**

(54) STABILIZER FOR FLOATING CONSTRUCT

(71) Applicant: Sean A. Barnes, Mt. Pleasant, SC (US)

(72) Inventor: Sean A. Barnes, Mt. Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/237,928

(22) Filed: Aug. 25, 2023

(65) Prior Publication Data

US 2023/0399084 A1 Dec. 14, 2023

Related U.S. Application Data

(63) Continuation of application No. 17/215,917, filed on Mar. 29, 2021, now Pat. No. 11,745,838, which is a continuation-in-part of application No. 17/079,813, filed on Oct. 26, 2020, now Pat. No. 11,447,216, which is a continuation-in-part of application No. 16/794,670, filed on Feb. 19, 2020, now Pat. No. 10,822,063, and a continuation-in-part of application (Continued)

(51) Int. Cl.

| | |
|---|---|
| ***B63C 1/02*** | (2006.01) |
| ***E02B 3/00*** | (2006.01) |
| ***E02B 3/06*** | (2006.01) |
| ***E02B 17/06*** | (2006.01) |
| *E02B 17/00* | (2006.01) |

(52) U.S. Cl.

CPC ..... *B63C 1/02* (2013.01); *E02B 3/064* (2013.01); *E02B 17/06* (2013.01); *E02B 2017/0056* (2013.01)

(58) Field of Classification Search

CPC ..... E02B 3/064; E02B 3/068; B63C 1/02

See application file for complete search history.

(56) References Cited

U.S. PATENT DOCUMENTS

| | | | |
|---|---|---|---|
| 3,074,239 | A | 1/1963 | Mustard |
| 3,270,698 | A | 9/1966 | Fort |
| RE27,090 | E | 3/1971 | Rutter |

(Continued)

FOREIGN PATENT DOCUMENTS

| | | |
|---|---|---|
| DE | 2042850 | 3/1972 |
| FR | 2860819 | 4/2005 |

(Continued)

OTHER PUBLICATIONS https://www.jetdock.com (excerpt printed Jan. 29, 2020).

(Continued)

*Primary Examiner* — Frederick L Lagman

(74) *Attorney, Agent, or Firm* — B. Craig Killough

(57) ABSTRACT

A boat lift is attached to piles driven into the earth or to another object. The boat lift is held in horizontal position relative to piles or the object to which it is attached, but vertical movement of the boat lift relative to the object is permitted. The boat lift is connected to the piles by modular units or cube constructs that have a post extending there through. The post has a blade extending from it. The blades are attached at an angle, according to the application, to pile guides that engage piles. The pile guides vertically traverse the piles, permitting the boat lift to move vertically relative to the object, but fixing the horizontal position of the boat lift.

16 Claims, 18 Drawing Sheets

Related U.S. Application Data

No. 16/830,343, filed on Mar. 26, 2020, now Pat. No. 11,535,995.

(60) Provisional application No. 62/851,783, filed on May 23, 2019.

(56) References Cited

U.S. PATENT DOCUMENTS

| | | | |
|---|---|---|---|
| 3,603,276 | A | 9/1971 | De Lisle |
| 3,727,415 | A | 4/1973 | Williams |
| 3,967,570 | A | 7/1976 | Bradfield |
| 4,018,179 | A | 4/1977 | Rutter |
| 4,072,119 | A | 2/1978 | Williams |
| 4,276,849 | A | 7/1981 | Bloxham |
| 4,280,429 | A | 7/1981 | Wells |
| 4,510,877 | A | 4/1985 | Bloxham |
| 4,641,595 | A | 2/1987 | Pritchett |
| 4,763,592 | A | 8/1988 | Russ |
| 4,782,778 | A | 11/1988 | Barbaglia |
| 5,002,000 | A | 3/1991 | Rutter |
| 5,016,551 | A | 5/1991 | Peck et al. |
| 5,046,897 | A | 9/1991 | Ray |
| 5,140,922 | A | 8/1992 | Bowman et al. |
| 5,394,814 | A | 3/1995 | Rutter et al. |
| 5,549,070 | A | 8/1996 | Cruchelow et al. |
| 5,664,513 | A | 9/1997 | Echelbarger |
| 5,795,098 | A | 8/1998 | Ruecker |
| 5,826,528 | A | 10/1998 | Jancsek |
| 5,860,379 | A | 1/1999 | Moody |
| 5,860,765 | A | 1/1999 | Cruchelow et al. |
| 6,145,463 | A | 11/2000 | Zeilinger |
| 6,179,525 | B1 | 1/2001 | Gruhn et al. |
| 6,477,968 | B2 | 11/2002 | Powell |
| 6,526,902 | B1 | 3/2003 | Faber |
| 6,547,485 | B2 | 4/2003 | Elson |
| D506,668 | S | 6/2005 | Black |
| 7,153,064 | B2 | 12/2006 | Zeilinger et al. |
| 7,390,141 | B2 | 6/2008 | Rytand |
| 7,406,924 | B1 | 8/2008 | Impey |
| 8,267,621 | B1 | 9/2012 | Way |
| 9,132,897 | B2 | 9/2015 | Barnes et al. |
| 9,352,812 | B1 | 5/2016 | Barnes et al. |
| 9,487,925 | B1 | 11/2016 | Meriweather et al. |
| 9,604,709 | B2 | 3/2017 | Barnes |
| D826,702 | S | 8/2018 | Barnes et al. |
| D828,746 | S | 9/2018 | Barnes et al. |
| D828,747 | S | 9/2018 | Barnes et al. |
| 10,086,919 | B2 | 10/2018 | Barnes |
| D837,041 | S | 1/2019 | Barnes et al. |
| 10,267,003 | B2 | 4/2019 | Barnes et al. |
| 10,370,073 | B2 | 8/2019 | Barnes |
| 10,822,063 | B1 * | 11/2020 | Barnes ..... B63B 35/38 |
| 11,447,216 | B2 * | 9/2022 | Barnes ..... B63B 35/38 |
| 11,745,838 | B2 * | 9/2023 | Barnes ..... E02B 3/20 114/45 |
| 2002/0131821 | A1 | 9/2002 | Elson |
| 2005/0002741 | A1 | 1/2005 | Brensinger et al. |
| 2005/0271477 | A1 | 12/2005 | Sehl |
| 2006/0156964 | A1 | 7/2006 | Canniffe et al. |
| 2007/0248420 | A1 | 10/2007 | Jacobs et al. |
| 2008/0014028 | A1 | 1/2008 | Faires et al. |
| 2008/0276851 | A1 | 11/2008 | Weed |
| 2008/0306642 | A1 | 12/2008 | Figura et al. |
| 2009/0235857 | A1 | 9/2009 | Hodapp |
| 2011/0146554 | A1 | 6/2011 | Wright et al. |
| 2011/0274502 | A1 | 11/2011 | Tibedo et al. |
| 2011/0277675 | A1 | 11/2011 | Thom et al. |
| 2014/0010593 | A1 | 1/2014 | Davis |
| 2021/0214059 | A1 | 7/2021 | Barnes |

FOREIGN PATENT DOCUMENTS

| | | |
|---|---|---|
| FR | 3017595 | 6/2014 |
| KR | 20160073441 | 6/2016 |
| RU | 2529124 | 9/2014 |
| WO | WO9914110 | 3/1999 |
| WO | WO2014035026 | 3/2014 |

OTHER PUBLICATIONS

Shoremaster, LLC, Official RhinoHoist Front Mount Floating Boat Life Video, YouTube, May 10, 2013, https://www.youtube.com/watch?v-ayxgoTHCij1.

* cited by examiner

STABILIZER FOR FLOATING CONSTRUCT

This Application is a Continuation of Continuation in Part application Ser. No. 17/215,917, filed Mar. 29, 2021, U.S. Pat. No. 11,745,838, issued Sep. 5, 2023, which is a Continuation in Part of application Ser. No. 17/079,813, filed Oct. 26, 2020, U.S. Pat. No. 11,447,216, issued Sep. 20, 2022, which is a Continuation in Part of application Ser. No. 16/794,670 filed Feb. 19, 2020, U.S. Pat. No. 10,822,063, issued Nov. 3, 2020, and is a Continuation of a Continuation in Part application Ser. No. 17/215,917, filed Mar. 29, 2021, U.S. Pat. No. 11,745,838, issued Sep. 5, 2023, which is a Continuation in Part of application Ser. No. 17/079,813, filed Oct. 26, 2020, U.S. Pat. No. 11,447,216, issued Sep. 20, 2022, which is a Continuation in Part of application Ser. No. 16/830,343, filed Mar. 26, 2020, U.S. Pat. No. 11,535,995, issued Dec. 27, 2022, which claims the benefit of Application Ser. No. 62/851,783, filed May 23, 2019, the benefit of which is claimed hereby.

Boat lifts are used to store boats over water. There is a need for a boat lift that can be quickly constructed, and will float on top of water as water levels change due to tides, wave action and other causes. The construct allows for imprecise positioning of piles that hold the boat lift horizontally in place.

SUMMARY OF THE INVENTION

A boat lift is attached to piles driven into the earth or to another object. The boat lift is held in horizontal position relative to piles or the object to which it is attached, but vertical movement of the boat lift relative to the object is permitted. The boat lift is connected to the piles by modular units or cube constructs that have a post extending there through. The post has a blade extending from it. The blades may be attached at an angle, according to the application, to pile guides that engage piles. The pile guides vertically traverse the piles, permitting the boat lift to move vertically relative to the object, but fixing the horizontal position of the boat lift.

BRIEF DRAWING DESCRIPTION

Figure 8:
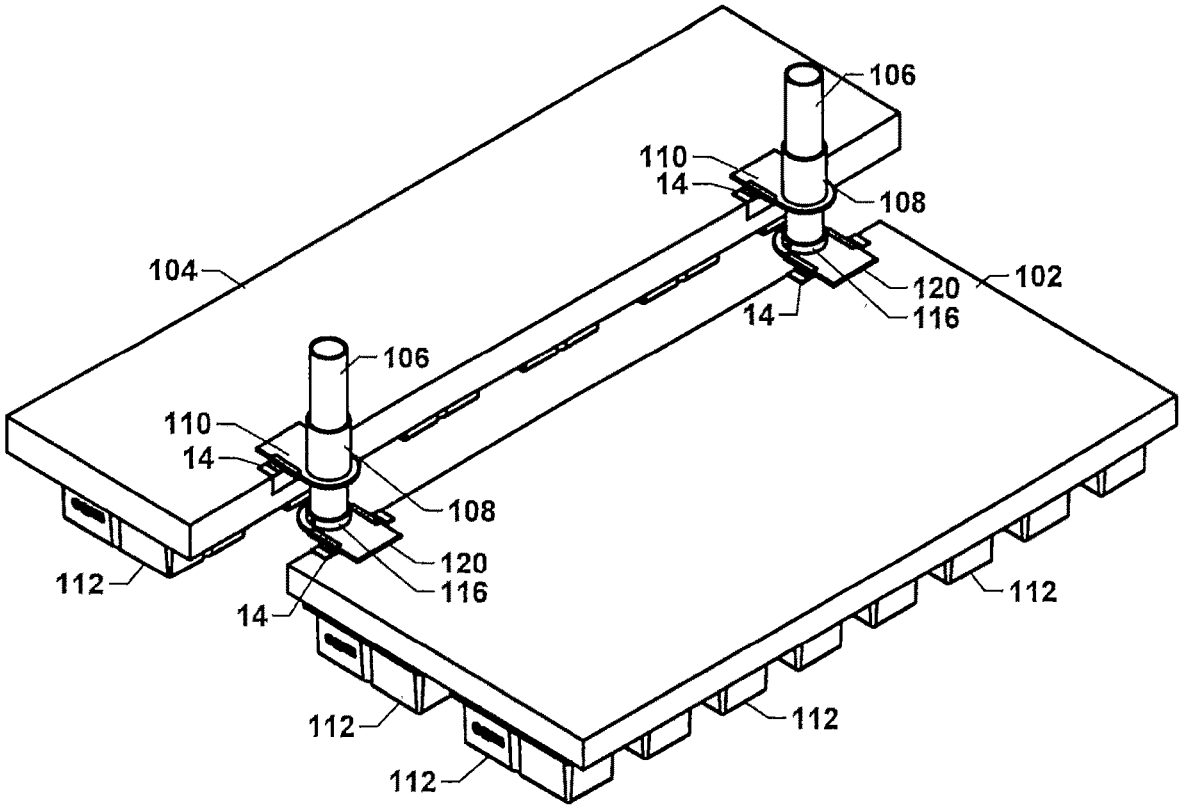
FIG. 8 is a perspective view of another embodiment of the invention in which a guide post is mounted to a slidable mounting.
Figure 9:
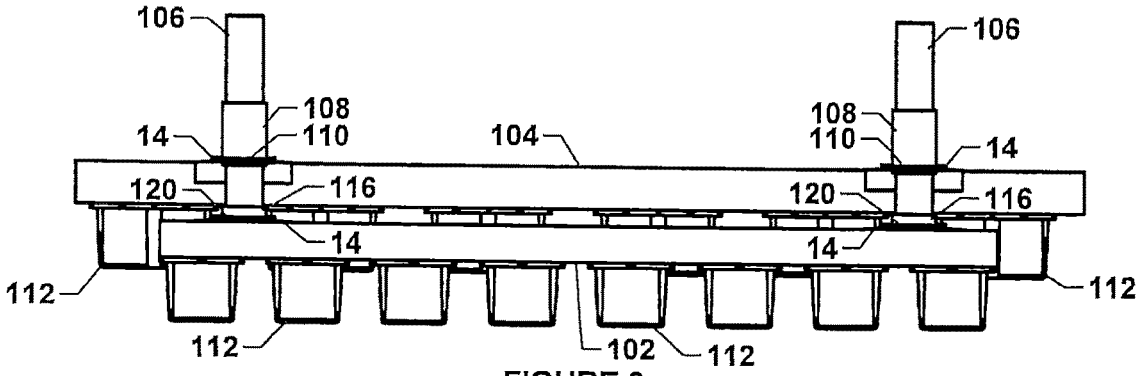
FIG. 9 is an elevation of the embodiment of FIG. 8.
Figure 10:
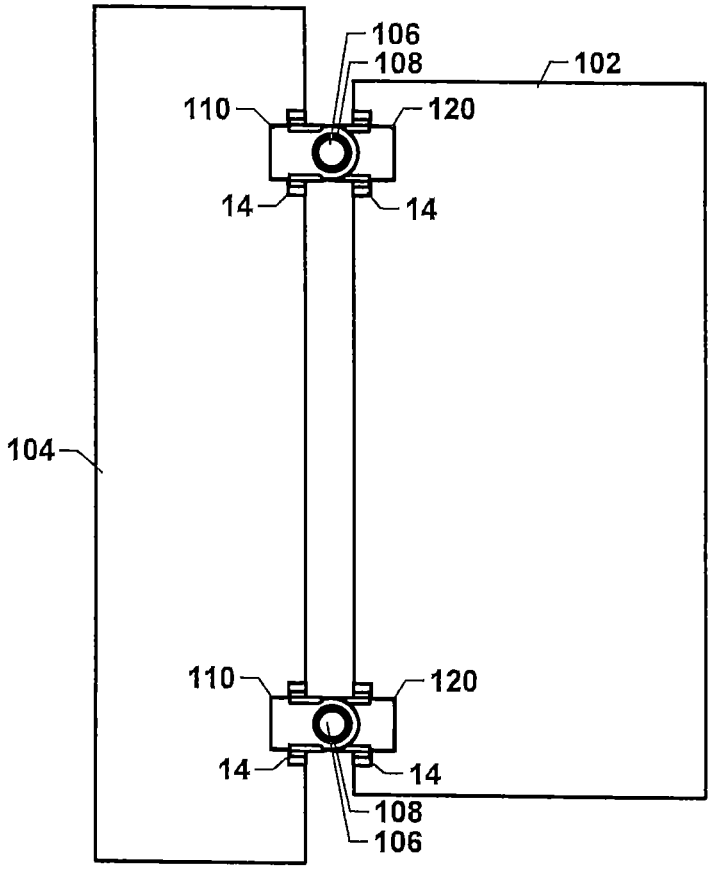
FIG. 10 is a top plan view of the embodiment of FIG. 8.
Figure 11:
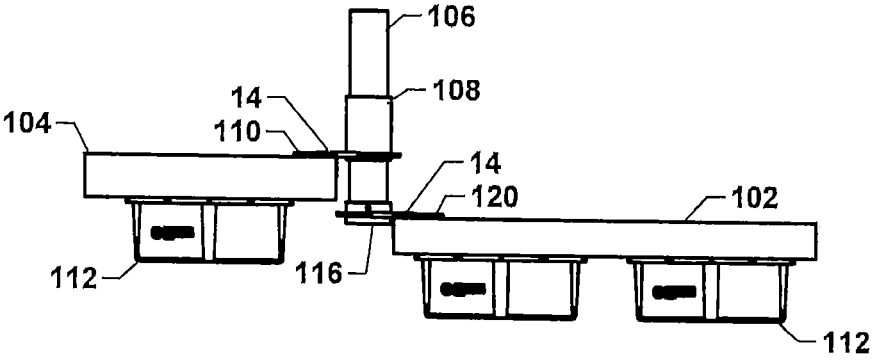
FIG. 11 is a side elevation of the embodiment of FIG. 8.
Figure 12:
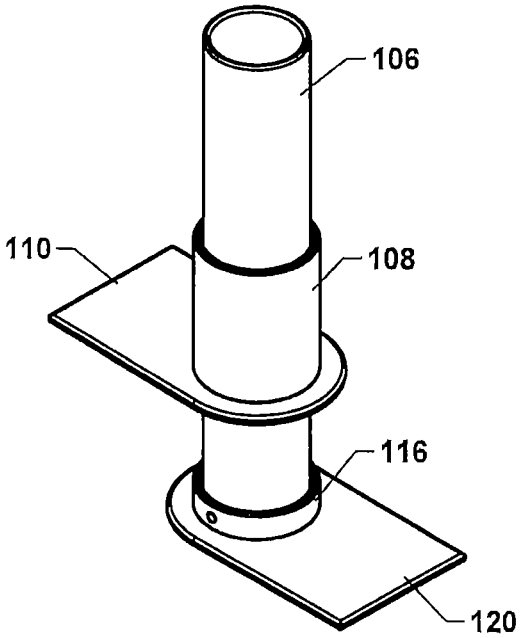

FIG. 12 demonstrates in isolation a guide post that is attached to and extends above the slidable mounting and is slidable relative to a guide that is slidably mounted to an object according to the embodiment of FIG. 8.

Figure 13:
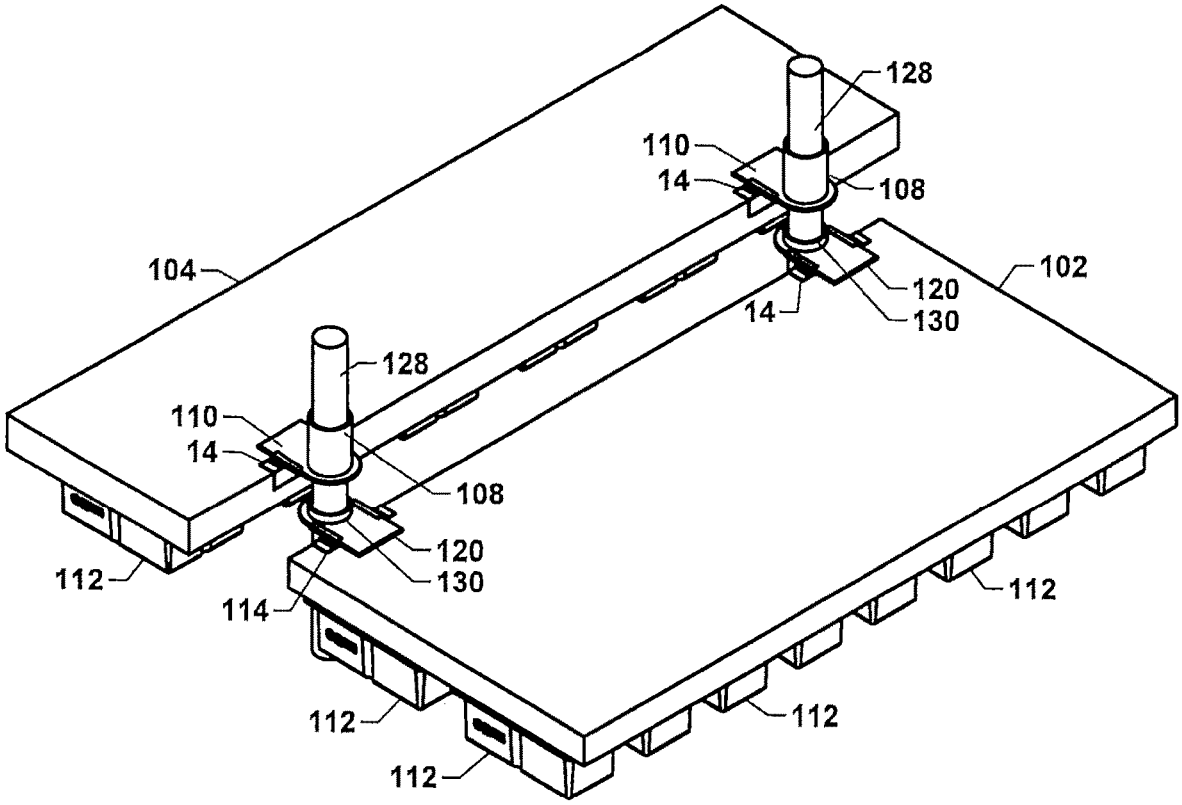

FIG. 13 is a perspective view of another embodiment of the invention in which a pile driven into the earth extends through pile guides associated with a floating platform and an object.

Figure 14:
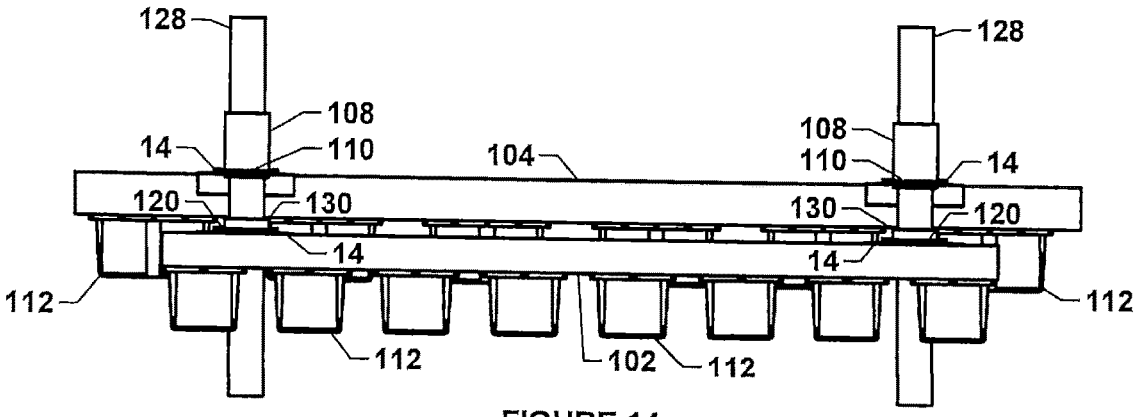

FIG. 14 is an elevation of the embodiment of FIG. 13.

Figure 15:
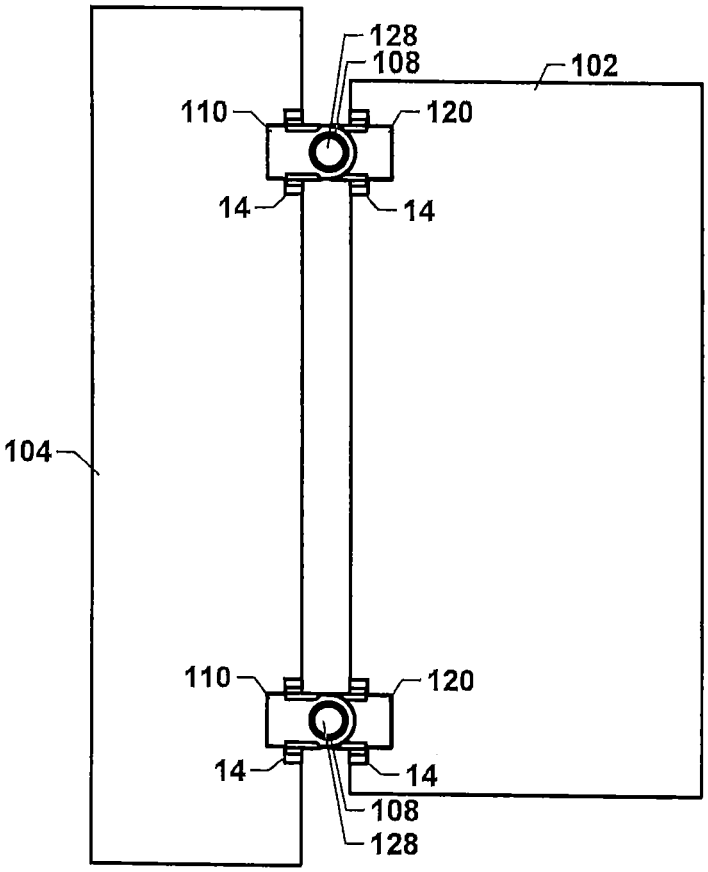

FIG. 15 is a top plan view of the embodiment of FIG. 13.

Figure 16:
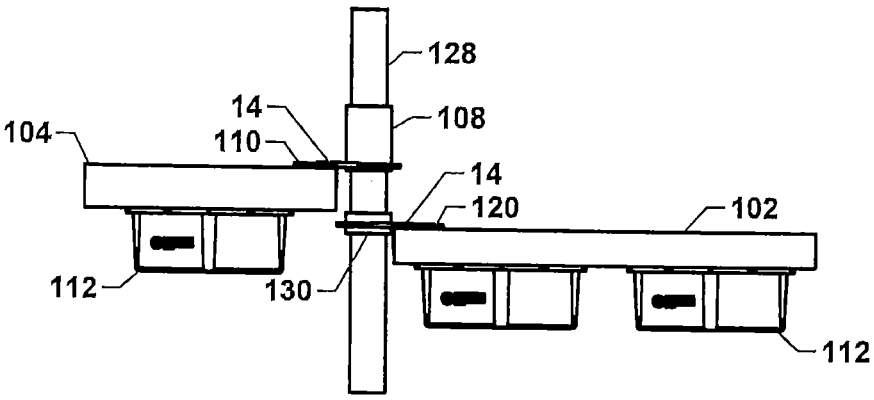

FIG. 16 is a side elevation of the embodiment of FIG. 13.

Figure 17:
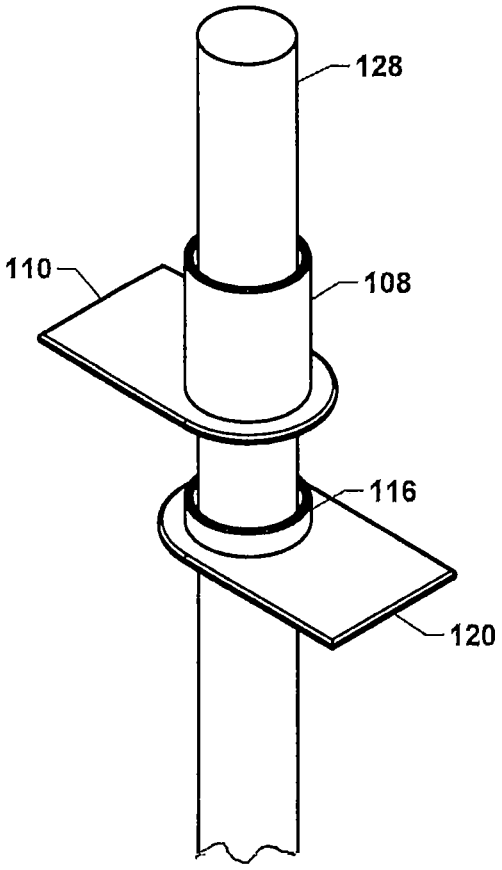

FIG. 17 demonstrates in isolation the pile driven into the earth extending above a guide that is slidably mounted to the object and is slidably mounted to the floating platform according to the embodiment of FIG. 13.

Figure 18:
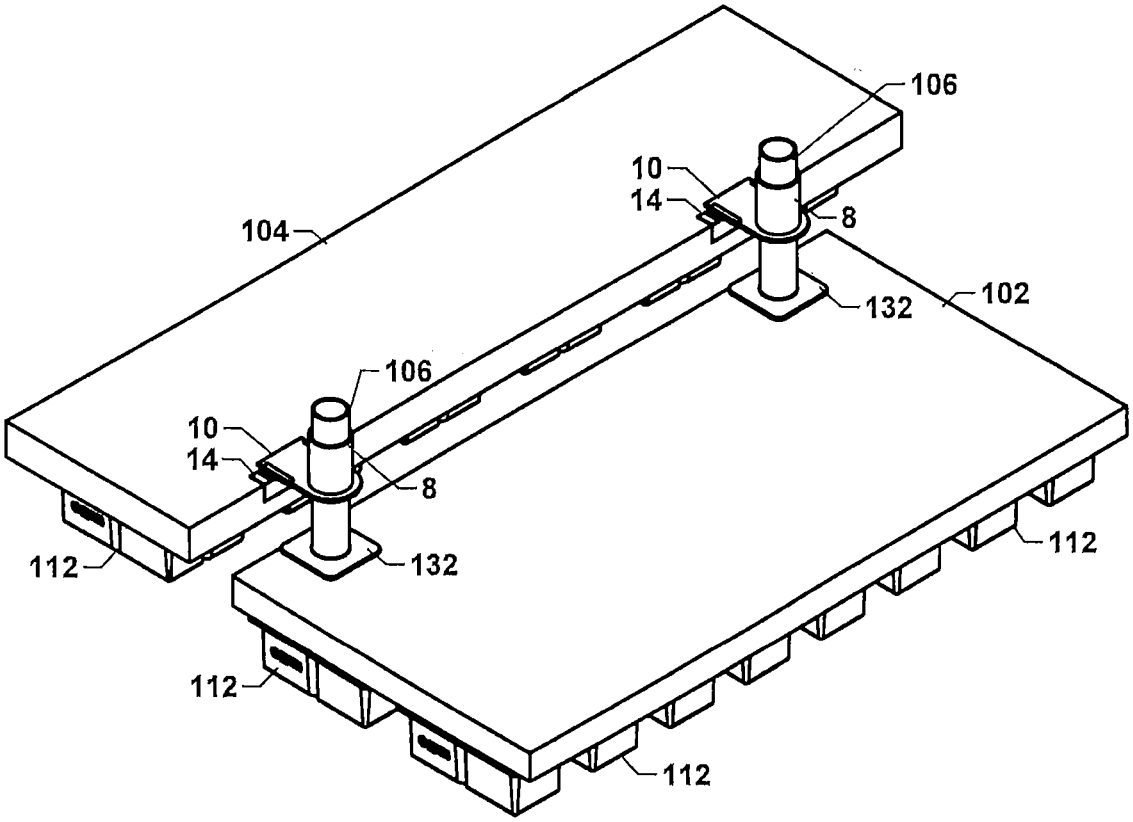

FIG. 18 is a perspective view of another embodiment of the invention in which a guide post is attached to the floating platform and extends through the pile guide mounted to the object.

Figure 19:
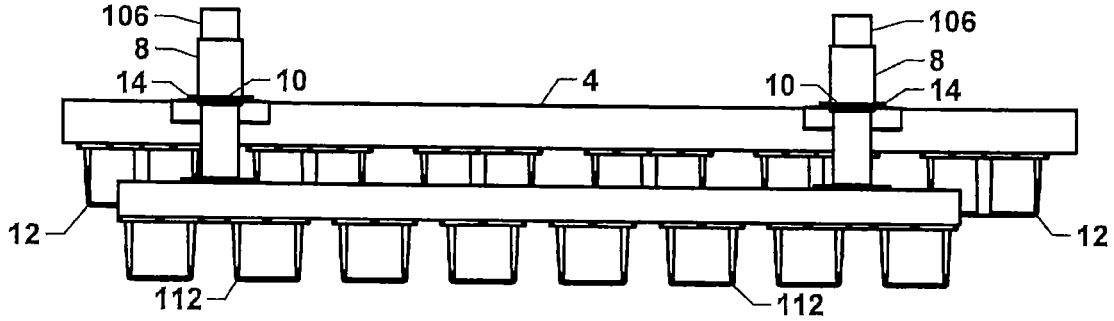

FIG. 19 is an elevation of the embodiment of FIG. 18.

Figure 20:
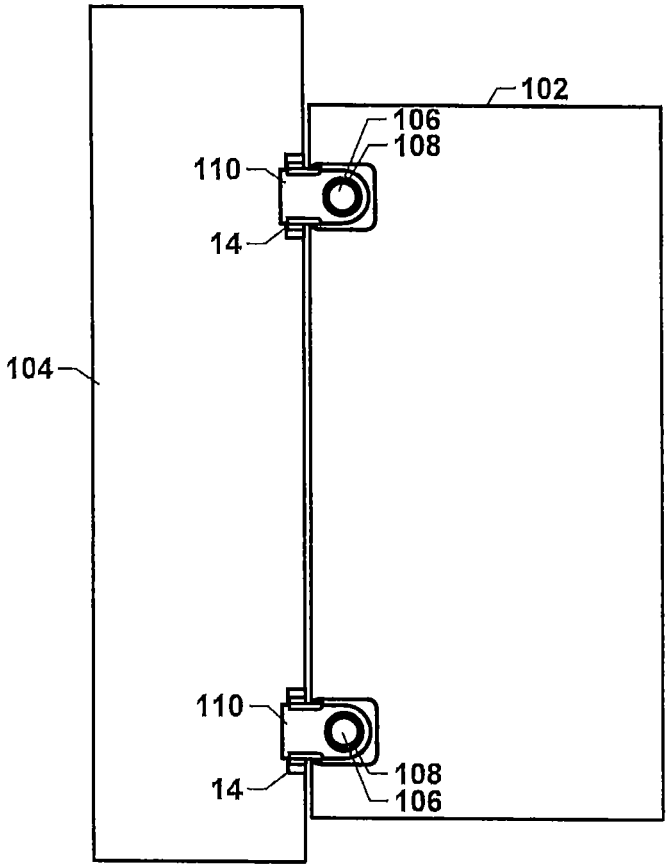

FIG. 20 is a top plan view of the embodiment of FIG. 18.

Figure 21:
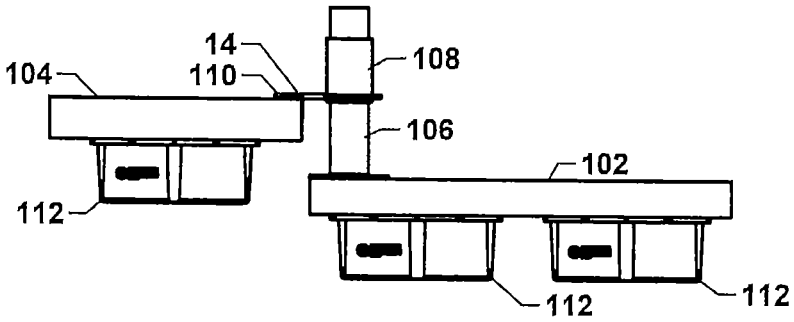

FIG. 21 is a side elevation of the embodiment of FIG. 18.

Figure 22:
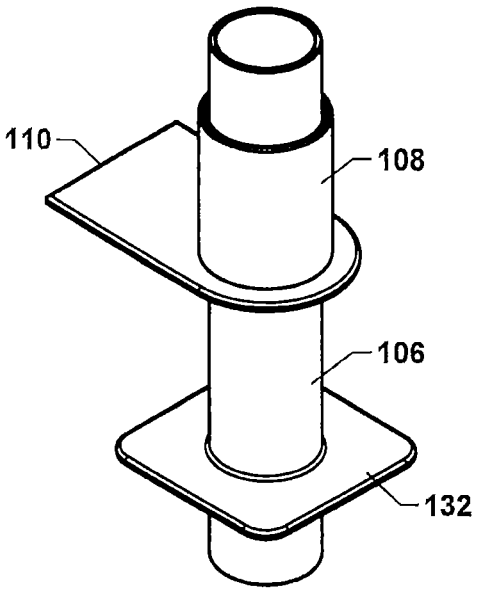

FIG. 22 demonstrates in isolation the guide post attached to the floating platform and the guide that is slidably mounted to an object according to the embodiment of FIG. 18.

Figure 23:
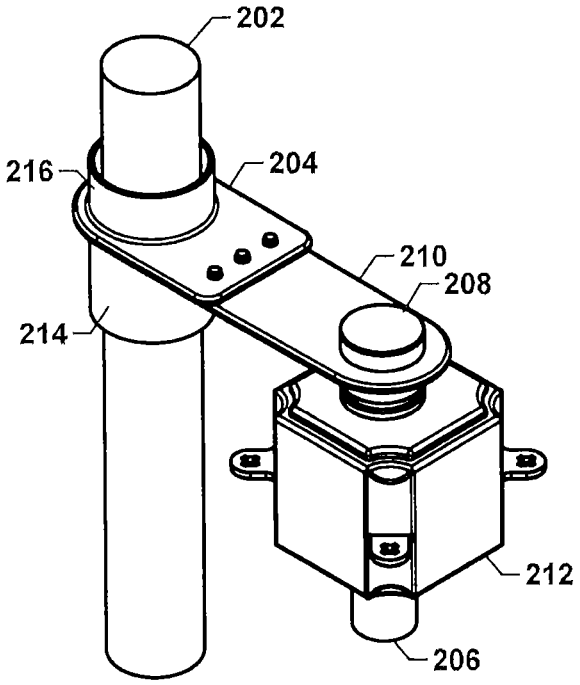

FIG. 23 is a perspective view of an embodiment of a stabilizer for a modular cube for use with a floating platform comprising floating units.

Figure 24:
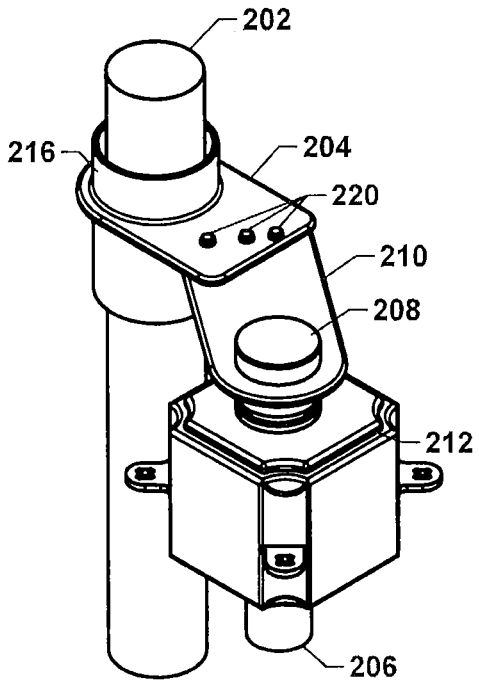

FIG. 24 is a perspective view of an embodiment of a stabilizer for a modular cube for use with a floating platform comprising floating units.

Figure 25:
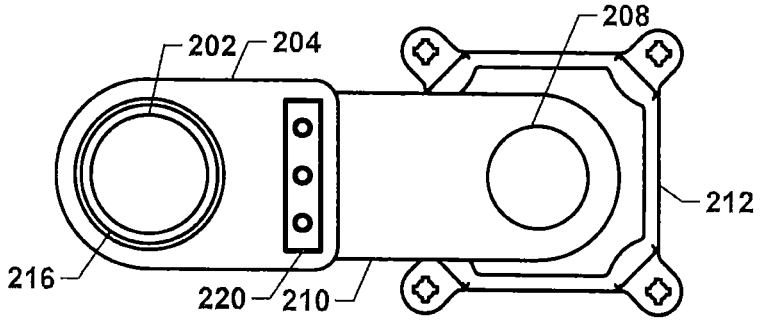

FIG. 25 is a top plan view of the embodiment of a stabilizer for a modular cube for use with a floating platform comprising floating units of FIG. 23.

Figure 26:
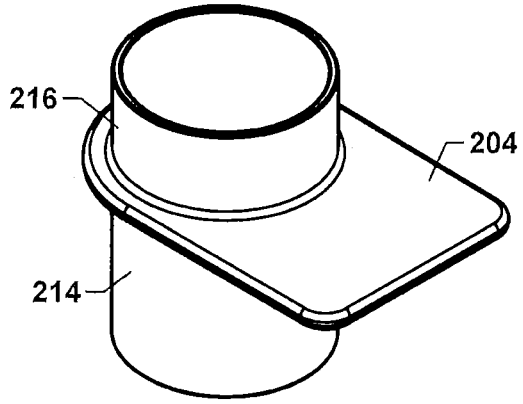

FIG. 26 is a pile guide useful with the stabilizer for a modular cube like that shown in FIGS. 23-25.

Figure 27:
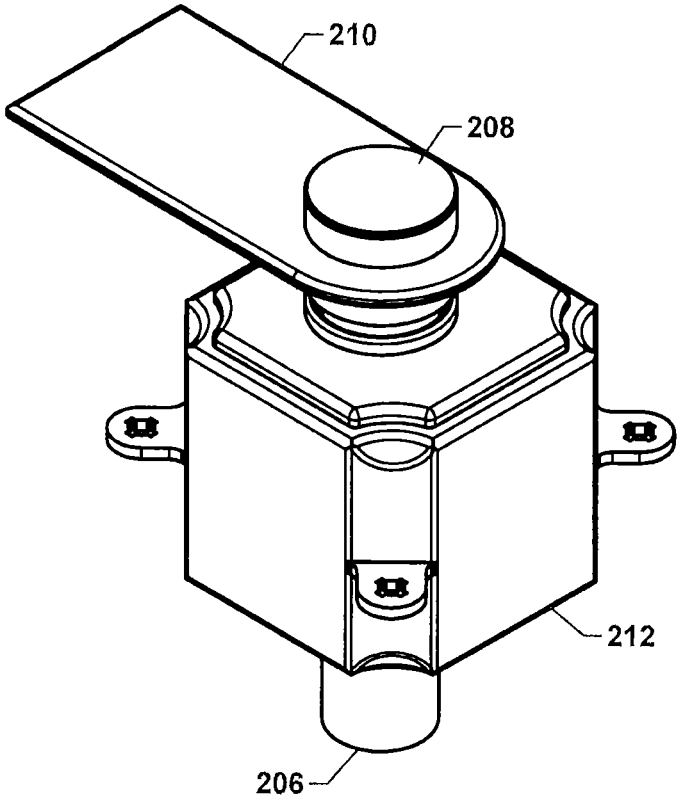

FIG. 27 is a partial view of the stabilizer of FIGS. 24 and 25 shown in perspective.

Figure 28:
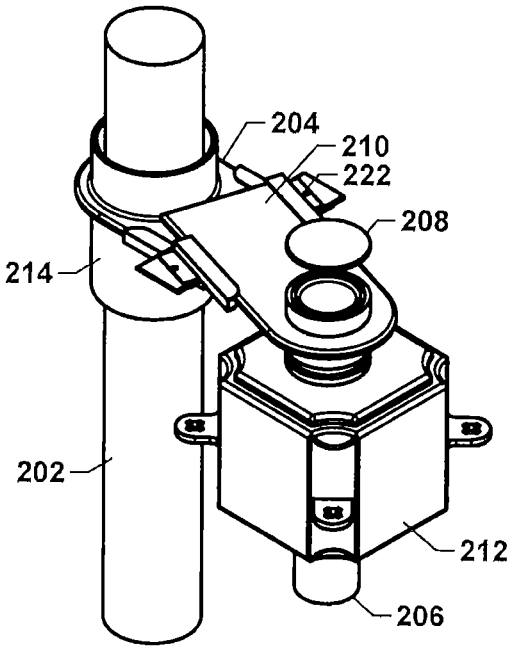

FIG. 28 is a perspective view of an embodiment of a stabilizer for a modular cube for use with a floating platform comprising floating units.

Figure 29:
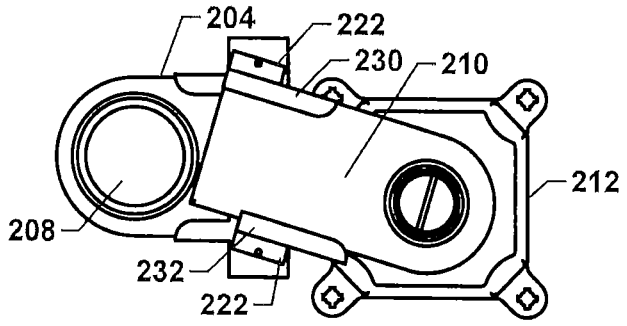

FIG. 29 is a top plan view of the embodiment of a stabilizer for a modular cube for use with a floating platform comprising floating units of FIG. 28.

Figure 30:
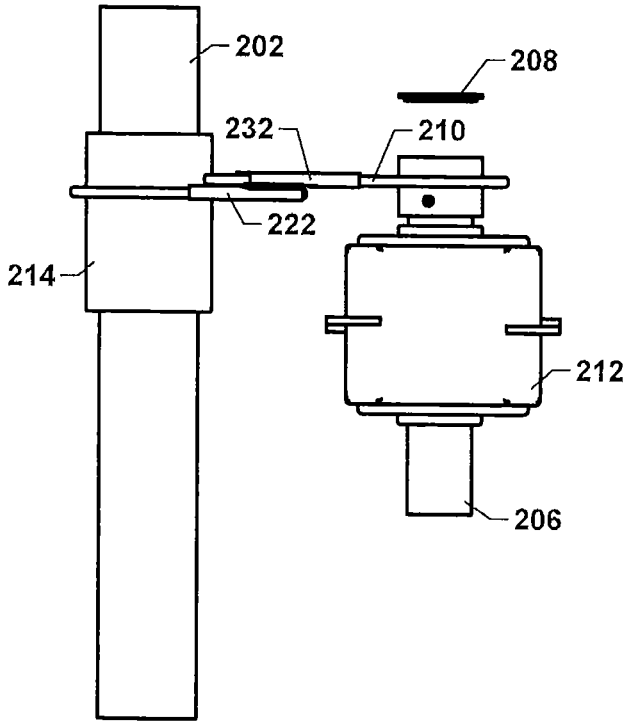

FIG. 30 is an elevation of the embodiment of a stabilizer for a modular cube for use with a floating platform comprising floating units of FIG. 28.

Figure 31:
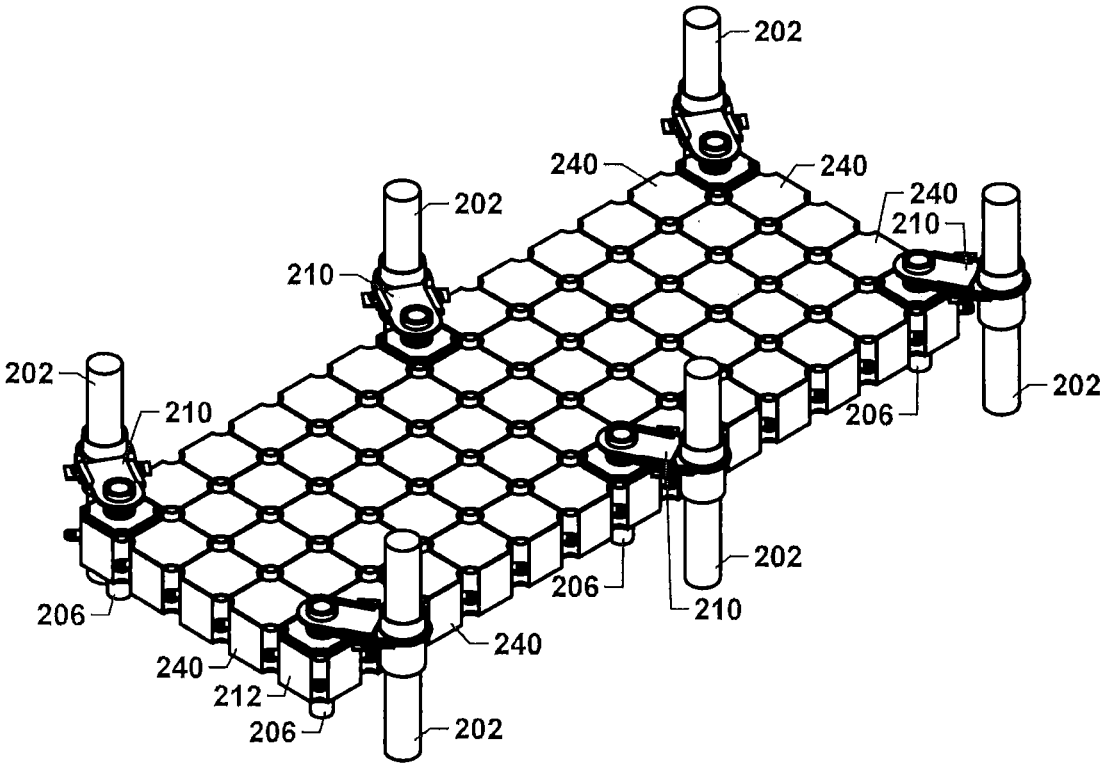

FIG. 31 is a perspective view of stabilizers for a modular cube used with a floating platform comprising a plurality of floating units.

Figure 32:
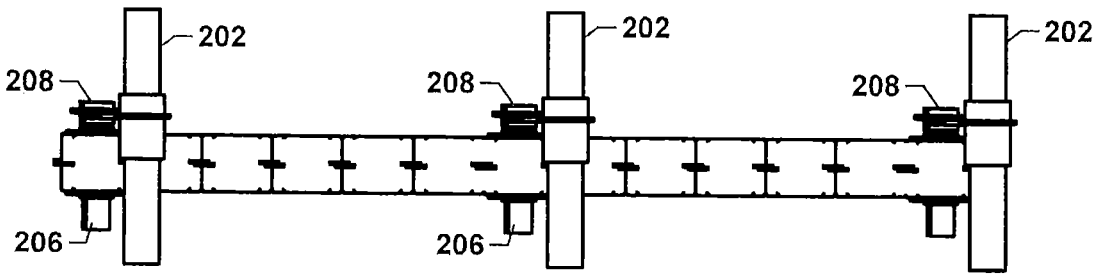

FIG. 32 is an elevation of stabilizers for a modular cube used with a floating platform comprising a plurality of floating units.

DESCRIPTION OF PREFERRED EMBODIMENTS

Figure 1:
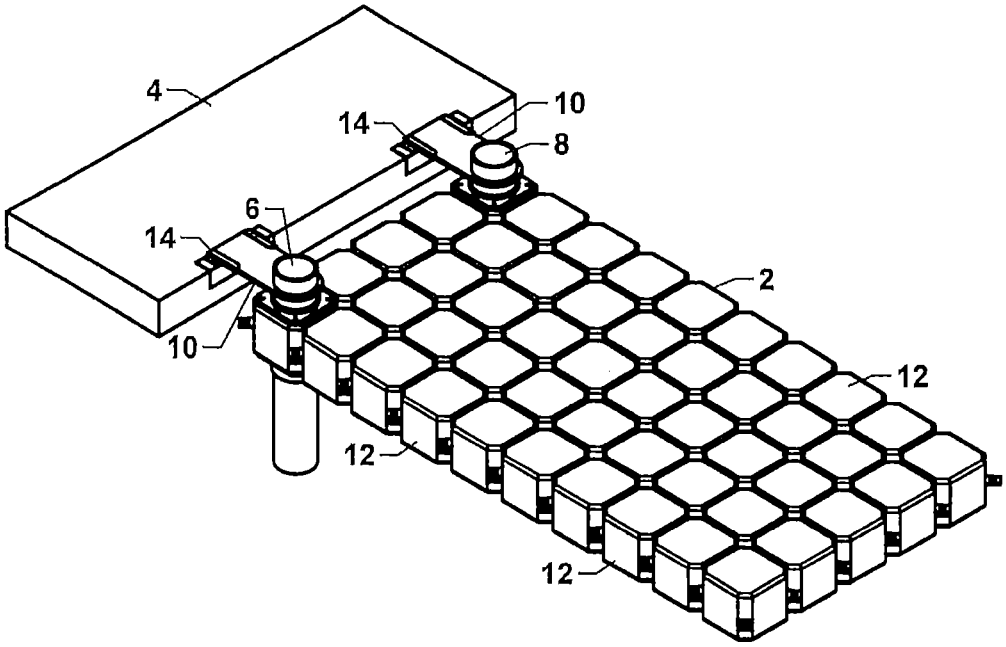
FIG. 1 is a perspective view of the floating platform according to the invention.
Figure 2:
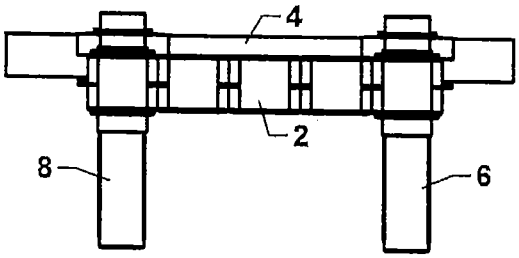
FIG. 2 is an elevation of the end the floating platform according to the invention.
Figure 3:
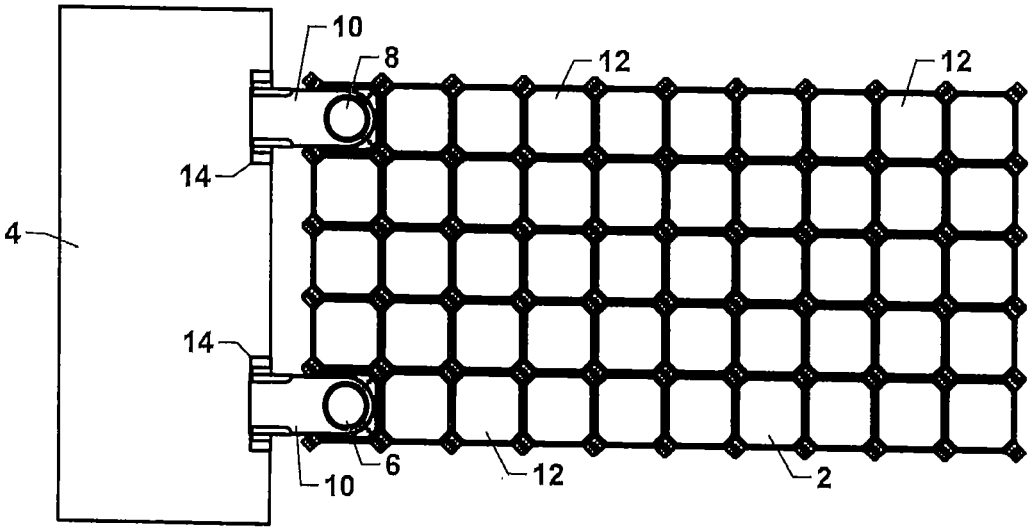
FIG. 3 is a top plan view of the floating platform.
Figure 4:
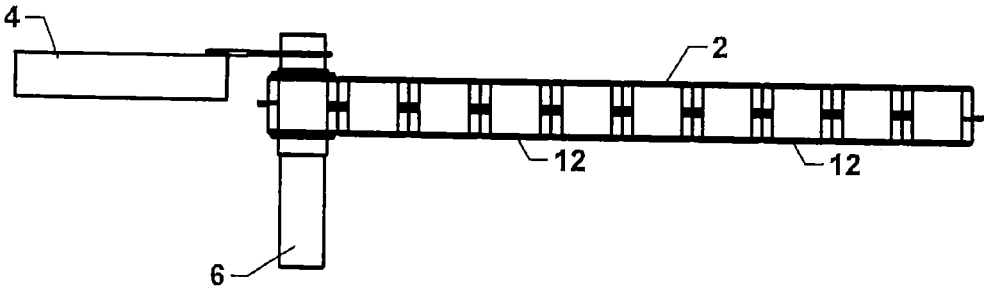
FIG. 4 is a side elevation of the floating platform.
Figure 5:
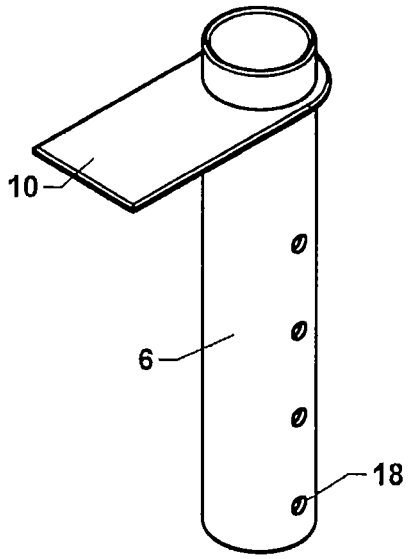
FIG. 5 is a perspective view of a guide post used with an embodiment of the invention.
Figure 6:
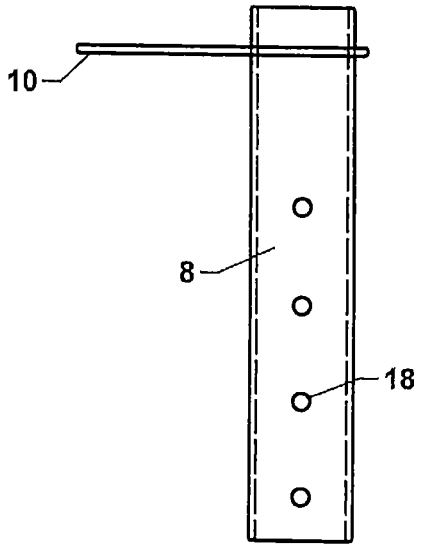
FIG. 6 is an elevation of the guide post shown in FIG. 5.
Figure 7:
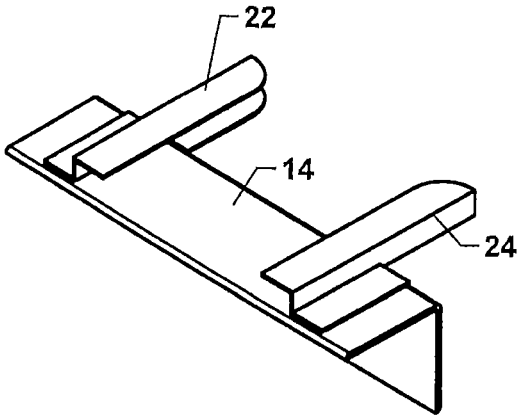
FIG. 7 is a perspective view of a bracket for receiving a blade of the guide post of FIG. 5.

The floating platform comprises a floating platform 2. The floating platform may be a floating dock or a raft or other platform that will float in water. The floating platform may be formed of wood, plastic or other materials that will float in water. As shown in the drawing figures, the floating platform is formed of a plurality of individual floating units 12 that are connected to form a rectangular floating platform. The floating platform as shown in FIG. 1 also has a generally level and planar top surface and can be used as a boat dock with the boat stored on top of the boat dock. The floating platform may be used as a staging area for tools and materials, or the floating platform may be used as a walkway, such as a catwalk. The floating platform may be formed in shapes other than a rectangular shape, and need not have a planar top surface.

Forming the floating platform 2 of individual floating units 12 allows the floating platform to be constructed in a desired shape and dimensions, and also allows quick assembly of the floating platform. The floating platform has particular utility as a temporary facility that can be quickly assembled. Further, the use of individual units to form the floating platform, or the use of other modular construction of the floating platform, allows for easy transportation of the floating platform which can be assembled on site, and without the necessity of special highway transportation.

The invention allows the floating platform 2 to be held in place relative to another object 4 without substantial horizontal movement of the floating platform. However, the floating platform according to the invention allows vertical movement of the floating platform relative to the object due to changes in water levels due to tides, weather, or wave action. The object may be in position relative to the earth, or the object may be another floating object. For example, the object could be a bulkhead fixed to the shore, or the object could be another floating platform or floating dock, or the additional object could be a vessel, such as a ship or a boat. Whether the object is fixed or floating, the floating platform construct of the invention allows vertical movement of the floating platform relative to the object while holding the floating platform substantially in position horizontally, although the horizontal positioning may be adjusted.

As shown in the embodiment of the drawings, guide posts 6,8 are used to connect the floating platform 2 to the object 4. A preferred guide post is an elongated object that engages receptacles formed in and extending through the floating platform. The guide posts each comprise a horizontal blade 10 that extends from a side of the guide post and near a top of the guide post.

In a preferred embodiment, at least two brackets 14 are mounted to the object 4. Each bracket has opposing members 22,24 that allow the blade 10 of a guide post 6,8 to slidably engage the bracket between the opposing members. The blade may be formed to a desired length, so that the floating platform 2 may be horizontally spaced from the object at a desired distance. With the blade being slidable within the brackets, this distance may be adjusted as desired by the user. After positioning the blades between the brackets, the distance of the floating platform to the object is adjusted and the blade is fixed to a position within the brackets such as by using one or more set screws to hold the blade and the guide post in a horizontal position relative to the object. The guide posts thereby hold the floating platform in a horizontal position relative to the object. The blades of the guide posts are positioned above the floating platform.

In one embodiment the brackets 14 are mounted under the object and/or under the floating platform. The blades of the pile guides slidably engage the brackets as described. Mounting the brackets and pile guides on a lower surface rather than a top surface of the object and/or floating platform removes an obstruction or tripping hazard from the top of the object and/or floating platform.

The guide posts 6,8 engage receptacles formed in and extending through the floating platform 2. The guide posts are fixed in position relative to the object as described above, but the floating platform moves vertically relative to the guide posts as the floating platform floats in changing water levels. The fit of the guide posts within the receptacles is such that the receptacles, and therefore the floating platform, can traverse the guide posts in a vertical direction. The floating platform can move vertically independent of the object 4 to which the floating platform is attached. In this manner, if the object is fixed to the earth, changes in water levels do not submerge the floating platform. Similarly, if the floating platform is attached to a floating object, such as a large vessel, the floating object has less tendency to pull the floating platform under the water in the event of violent wave action.

The guide posts 6,8 may be formed to a length that is required by the application. For example, if the object 4 is fixed to the earth and the floating platform 2 is subject to two (2) meter tides, the guide posts may have a length of three (3) meters or more. In some applications it may be desirable to have a stop on the guide posts. The stop may be a pin inserted through a void 18 of the guide post so that the floating platform does not disengage from the guide post in the event of an extremely low water level due to tides, wave action or other causes.

The guide posts 6,8 may have a round cross section, and form an elongated cylindrical shape. If the guide posts are hollow, a cap may be placed over the top of the guide posts, so that the guide post may be used as a step for entering or leaving the floating platform 2. The receptacles are formed as voids having a complementary shape to the guide posts so that the floating platform moves vertically the guide posts as water levels change. The guide posts and receptacles could have other complimentary shapes. The receptacles and guide posts are preferred to be formed of polyethylene, and particularly high-density polyethylene, which is extremely durable, corrosion resistant, and has low friction qualities that facilitate the movement required by the objects of the invention. Low density polyethylene may be used in other applications.

In a preferred embodiment, the guide posts have a specific gravity of less than 1.0 so that they float in water and provide buoyancy to retard deflection of the blade over time. In a specific embodiment the guide posts are hollow but are capped or otherwise sealed to prevent water intrusion into the center of the guide posts so as to provide buoyancy. The hollow guide posts may be made of materials having a specific gravity of less than 1.0. An example of such materials is polyethylene.

FIGS. 8-12 show an additional embodiment of the invention. The floating platform 102 may be a floating dock or similar platform that will float in water. The floating platform may be formed of floating members. The floating platform may be formed of wood, plastic or other materials that will float in water. The floating platform may have a hard surface, such as a surface formed of wood planking. The floating platform as shown in FIG. 8 may have a generally level and planar top surface. The floating platform may be configured for use as a boat dock with the boat stored on top of the floating platform and out of the water, such as a v-shape for accommodating a boat hull. The floating platform may be used as a staging area for tools and materials, or the floating platform may be used as a walkway, such as a catwalk. The floating platform may be formed in shapes other than a rectangular shape, and may not have a planar top surface.

The invention allows the floating platform 102 to be held in place relative to another object 104 without substantial horizontal movement of the floating platform. However, the floating platform according to the invention allows vertical movement of the floating platform relative to the object due to changes in water levels due to tides, weather, or wave action. The object may be in a fixed position relative to the earth, or the object may be another floating object with floats 112. For example, the object could be a bulkhead fixed to the shore, or the object could be another floating platform or floating dock, or the additional object could be a vessel, such as a ship or a boat. Whether the object is fixed or floating, the floating platform construct of the invention allows vertical movement of the floating platform relative to the object while holding the floating platform substantially in position horizontally, although the horizontal positioning may be adjusted.

At least two brackets 14 are mounted to the object 104. Each bracket has opposing members that allow the blade 110 of a guide to slidably engage the bracket between the opposing members. The blade 110 may be formed to a desired length, so that the floating platform 102 may be horizontally spaced from the object at a desired distance. With the blade being slidable within the brackets, this distance may be adjusted as desired by the user. After positioning the blades between the brackets, the horizontal distance of the floating platform to the object is adjusted and the blade is fixed to a position within the brackets such as by using a set screw to hold the blade and the guide post in a horizontal position relative to the object. The guide posts thereby hold the floating platform in a position relative to the object.

Guide posts 106 engage a cylinder 108 that extends above the blade 110. The blade, cylinder and bracket form a pile guide that limits horizontal movement of the guide posts and the floating platform 102 relative to the object 104. In this embodiment, the guide posts are fixed to blades 120 that slide relative to brackets 14 attached to the floating platform. The guide posts may be mounted to the blades 120 by a collar 116 that holds the guide post in position. The blades 120 may be formed to a desired length and positioned within the brackets so that the floating platform 102 may be horizontally spaced from the object at a desired distance, just as the object 104 may be spaced at a desired distance from the guide posts and floating platform through the use of the slidable blades 110. With the blades 120 being slidable within the brackets, this distance may be adjusted as desired by the user or installer. After positioning the blades between the brackets, the horizontal distance of the guide posts to the floating platform is adjusted and the blade is fixed to a position within the brackets, such as by using one or more set screws to hold the blade and the guide posts in the desired position.

In this embodiment the floating platform 102 is free to move vertically relative to the object 104 as the floating platform and/or the object floats in changing water levels. The fit of the guide posts 106 within the cylinder 108 is such that the guide posts, and therefore the floating platform, can move or slide vertically within the cylinder and move vertically relative to the object 104. The cylinder and the guide posts may be formed in other geometric shapes, and could be square in cross section for example, and long as relative movement is provided as described. The floating platform can move vertically independently of the object 104 to which the floating platform is attached. In this manner, if the object is fixed to the earth, changes in water levels do not submerge the floating platform. Similarly, if the floating platform is attached to a floating object, such as a large vessel, the floating object has less tendency to pull the floating platform under the water in the event of violent wave action.

The guide posts 106 may be formed to a length that is required by the application. For example, if the object 104 is fixed to the earth and the floating platform 102 is subject to two (2) meter tides, the guide posts may have a length of three (3) meters or more. In some applications it may be desirable to have a stop on the guide posts. The stop may be a pin inserted through a void of the guide post so that the floating platform does not disengage from the cylinder 108 in the event of an extremely low water level due to tides, wave action or other causes.

The guide posts 106 may have a round cross section, and form an elongated cylindrical shape. The cylinders 108 comprise voids having a complementary shape to the guide posts so that the floating platform moves vertically relative to the object 104 as water levels change. The guide posts and cylinders may have other complimentary shapes. The receptacles and guide posts are preferred to be formed of polyethylene, and particularly high-density polyethylene, which is extremely durable, corrosion resistant, and has low friction qualities that facilitate the movement required by the objects of the invention. Low density polyethylene may be used in other applications.

FIGS. 13-17 show an embodiment that is similar to the embodiment of FIGS. 8-12, with the object 104, floating platform 102 and associated components being the same as indicated by like reference numbers. In this embodiment, the guide posts are static piles 128 driven into the earth. The piles slidably engage pile guides 130 that are mounted to the floating member such as a floating dock and to pile guides 108 mounted to the object. In this embodiment the floating platform 102 moves vertically relative the piles 128 as the floating platform and/or the object floats in changing water levels. The fit of the piles within the pile guides is such that floating platform can move vertically relative to the fixed piles and move vertically relative to the object. The pile guides and the piles may be formed in desired geometric cross sections, and could be round or square in cross section for example, and long as relative movement is provided as described.

FIGS. 18-22 show an embodiment that is similar to the embodiments of FIGS. 8-17, with the object 104, floating platform 102 and associated components being the same as indicated by like reference numbers. In this embodiment, the guide posts 106 are mounted to the floating platform 102 such as by mounting 132, and therefore move as the floating platform moves. The guide posts slidably engage pile guides 108 that are mounted to the object. In this embodiment the floating platform moves vertically relative to the object as the floating platform and/or the object floats in changing water levels. The fit of the guide posts within the pile guides is such that floating platform can move vertically relative to the object 104. The pile guides and the guide posts may be formed in desired geometric cross sections, and could be round or square in cross section for example, and long as relative movement is provided as described.

FIGS. 23-30 show devices for securing a boat lift formed of modular cubes, such as the boat lift shown in FIGS. 32-33. A modular cube 212 has a void extending through the modular cube. The void may be cylindrical in shape. The cube may be sealed and have a specific gravity of less than 1.0, so that it floats in water. The cube is constructed to be attached to other floating modular cubes 240 to form a floating boat lift. The cubes 212 and 240 could be of other geometric shapes as long as multiple units of cubes are connected to form the boat lift, which is connected to a floating dock, or piles, or a bulkhead or a similar fixed object.

The void in the cube 212 accepts a post 206 through the void. In a preferred embodiment, the post and cube 212 slide relative to each other. In most applications, the void in the cube 212 is cylindrical, and the post has a round cross section. A blade 210 extends from the post, preferably at or near the top of the post. The blade may extend from a cap 208. The blade is relatively thin and wide relative to the thickness of the blade, with the wide part of the blade being positioned generally horizontally as shown in the drawing figures.

The blade 210 is attached to a blade 204 of a pile guide 214. The pile guide blade 204 is typically relatively thin and wide relative to the thickness of the blade, with the wide part of the blade being positioned generally horizontally as shown in the drawing figures. The blade 210 of the post is connected to the pile guide blade 204 such as by bolting the blades together with fasteners 220. The blades may be connected to each other at an angle desired by the installer, or as dictated by the location of preexisting piles 202. Piles are typically driven into the ground, and alignment errors frequently arise, since driving the piles is an imprecise process. Providing a pile guide with a blade and a post with a blade permits the cube 212 to be offset from the pile 202 as needed by the installation limitations due to pile positioning.

The pile guide 214 is constructed to traverse pile 202 permitting vertical movement of the boat lift relative to the pile. The pile guide has a collar portion through which the pile extends. The collar substantially prevents horizontal movement of the boat lift, but permits vertical movement of the boat lift.

The post 206, the blade 210, the cap 208, and the pile guide 214 are preferred to be formed of polyethylene, and more specifically medium density or high-density polyethylene. Polyethylene is resistant to corrosion, but is highly durable and resist tearing or breaking. The post 206 may have voids 18 formed like post 6 into which a lower stop may be incorporated, such as by inserting a pin through a void.

In the embodiment of the device shown in FIGS. 28-30, the blade 210 of the post 206 engages a bracket 222 that is mounted to a pile guide 214. The opposing sides 230, 232 of the bracket each form a U shape that allows blade to 210 to slide between them. The sliding feature allows the cube 212 to be positioned horizontally as desired during construction of the boat lift. When the cube 212 is positioned as desired, the blade 210 is fixed relative to the bracket, such as by bolting or otherwise fastening the blade in position relative to blade 204.

The bracket 222 allows the opposing sides 230,232 to pivot up to about 22.5° in either direction, for a total of about 45° of travel. Pivoting of the opposing sides of the bracket as demonstrated by FIG. 29 permits the cube 212 to be offset from the pile 202 as needed by the installation limitations due to pile positioning. After the cube is positioned as needed relative to the pile 202, the blade 210 is fixed in place such as by fastening the blade to the bracket with fasteners. The combination of pivoting and sliding of the blade 210 yields adjustability in positioning of the cube 210 and the boat lift relative to the piles.

FIGS. 31-32 show a boat lift formed of modular cubes 240. The boat lift is held in place by a plurality of piles 202 that are connected by the modular cubes 212 of FIGS. 23-29, and more specifically, by the construct shown in FIGS. 27-30. Typically, at least two modular cubes 212 are required per boat lift.

In another embodiment, blades 210 extending from posts 206 are attached to a fixed device, such as a bulkhead, or a floating object, such as a floating dock or vessel. The blade may be attached by fasteners, such as nuts and bolts, or other known fasteners. The posts extend through modular cubes 212 which are part of a dock such as the dock shown in FIG. 31, but the blades are connected to another object as described in this paragraph rather than being connected to pile guides.

In yet another embodiment, piles extend through the voids in the modular cubes 212. The post and blade construct is not used in this embodiment. The modular cubes 212 are connected to modular cubes to 240 form a dock like in FIG. 31. The voids in the modular cubes 212 of this embodiment are constructed and arranged within the modular cubes 212 to accept piles 202 and permit vertical travel of the modular cubes and the dock relative to the piles, while limiting horizontal movement of the dock.

What is claimed:

1. A stabilizer for a floating construct, comprising:

a unit that is part of a floating construct, the unit comprising a void extending though the unit;

a stabilizer of the floating construct comprising a guide post that extends through the void of the unit and extends above a top of the unit and is longer than the void in the unit, the stabilizer comprising a blade that extends from an upper portion of the guide post, the blade extending beyond a side of the unit, wherein the guide post slidably engages the unit and permits limited vertical travel of the unit relative to the guide post.

2. A stabilizer for a floating construct as described in claim 1, further comprising a pile guide, the pile guide comprising a blade that extends to a side of a collar of the pile guide, the collar constructed and arranged to receive a pile therethrough, wherein the blade of the collar is attached to the blade of the stabilizer.

3. A stabilizer for a floating construct as described in claim 1, further comprising a pile guide, the pile guide comprising a blade that extends to a side of a collar of the pile guide, the collar constructed and arranged to receive a pile therethrough, wherein the blade of the collar is attached to the blade of the stabilizer at an obtuse angle.

4. A stabilizer for a floating construct as described in claim 1, further comprising a pile guide, the pile guide comprising a bracket, the bracket comprising opposing members, the pile guide constructed and arranged to receive a pile therethrough, wherein the blade of the stabilizer is positioned between the opposing members.

5. The stabilizer for a floating construct as described in claim 1, further comprising a pile guide, the pile guide comprising a blade that extends to a side of a collar of the pile guide, the pile guide comprising a bracket, the bracket comprising opposing members, wherein the blade of the stabilizer is positioned between the opposing members, the collar constructed and arranged to receive a pile therethrough.

6. A stabilizer for a floating construct as described in claim 1, further comprising a pile guide, the pile guide comprising a blade that extends to a side of a collar of the pile guide, the pile guide comprising a bracket, the bracket comprising opposing members, wherein the blade of the stabilizer is positioned between the opposing members and the blade of the pile guide is positioned at an obtuse angle to the blade if the blade of the unit.

7. A stabilizer for a floating construct as described in claim 1, wherein the guide post of the stabilizer is formed of polyethylene.

8. A stabilizer for a floating construct as described in claim 1, wherein the guide post and the blade of the stabilizer are formed of polyethylene.

9. A stabilizer for a floating construct as described in claim 1, wherein the guide post of the stabilizer has a geometric cross-section.

10. A stabilizer for a floating construct as described in claim 1, wherein the blade is a blade that extends from an upper portion of the guide post, and the blade is adjustable within a receptacle.

11. A stabilizer for a floating construct as described in claim 1, wherein the blade is attached to an object to which the floating construct is connected.

12. A stabilizer for a floating construct as described in claim 1, comprising a second stabilizer of the floating construct that is spaced apart from the stabilizer, wherein the second stabilizer comprises a guide post that extends through a second unit and extends above a top of the second unit and is longer than the void in the second unit, the second stabilizer comprising a blade that extends from an upper portion of its guide post, and further comprising a platform that comprises a plurality of units, and the plurality of units comprise the unit and the second unit.

13. A stabilizer for a floating construct as described in claim 1, wherein the blade is mounted to a fixed object.

14. A stabilizer for a floating construct as described in claim 1, wherein the guide post is a pile.

15. A stabilizer for a floating construct as described in claim 1, wherein the guide post comprises a stop near a lower end of the guide post and below the unit wherein the stop is constructed and arranged to limit travel of the unit relative to the guide post.

16. A stabilizer for a floating construct as described in claim 1, wherein the guide post of the stabilizer has a geometric cross-section and the void in the unit has a geometric cross section.

* * * * *